US006333474B1

(12) United States Patent
Aluise, Sr.

(10) Patent No.: US 6,333,474 B1
(45) Date of Patent: Dec. 25, 2001

(54) DISTRIBUTOR ROTOR

(75) Inventor: Joseph R. Aluise, Sr., Beltsville, MD (US)

(73) Assignee: Metro Motorsports, Inc., Beltsville, MD (US)

( * ) Notice: Subject to any disclaimer, the term of this patent is extended or adjusted under 35 U.S.C. 154(b) by 0 days.

(21) Appl. No.: 09/644,575

(22) Filed: Aug. 24, 2000

(51) Int. Cl.[7] ..... H01H 19/00
(52) U.S. Cl. ..... 200/19.33
(58) Field of Search ..... 200/19.2–19.39, 200/19.01–19.19, 19.4; 123/146.5 R, 146.5 A

(56) References Cited

U.S. PATENT DOCUMENTS

| | | | | |
|---|---|---|---|---|
| 1,385,625 | | 7/1921 | Kent | 200/19.33 |
| 2,790,020 | | 4/1957 | Redick et al. | 123/146.5 A |
| 3,614,359 | * | 10/1971 | Beck | 200/19.33 |
| 3,887,780 | | 6/1975 | Crim | 200/19.33 |
| 3,941,107 | | 3/1976 | Rockwell | 200/19.33 X |
| 4,023,546 | * | 5/1977 | Kaswakami | 200/19.32 X |
| 4,030,466 | | 6/1977 | Lace | 200/19.33 X |
| 4,036,197 | | 7/1977 | Beshore | 123/146.5 A |
| 4,077,378 | | 3/1978 | Okumura | 123/633 |
| 4,096,840 | | 6/1978 | Jordan | 123/146.5 A |
| 4,185,600 | | 1/1980 | Brammer et al. | 123/146.5 A |
| 4,186,286 | | 1/1980 | Kuo et al. | 200/19.33 |
| 4,302,638 | | 11/1981 | Fox et al. | 200/19.32 |
| 4,321,895 | | 3/1982 | Fox et al. | 123/146.5 A |
| 5,057,653 | * | 10/1991 | Haug et al. | 200/19.39 |
| 5,351,670 | | 10/1994 | Buma et al. | 200/19.32 X |

* cited by examiner

*Primary Examiner*—J. R. Scott
(74) *Attorney, Agent, or Firm*—Arent Fox Kintner Plotkin & Kahn, PLLC

(57) ABSTRACT

A distributor rotor for use with an after market distributor cap that is secured to a computer controlled electronic distributor that distributes voltages to spark plugs in internal combustion engines by a distributor cap adapter. The distributor rotor is injection molded and has a stainless steel spring contact and a metallic contact overlaid the stainless steel spring contact, thereby relocating the critical electrical contacts to a desired location when used with the after market distributor cap.

14 Claims, 1 Drawing Sheet

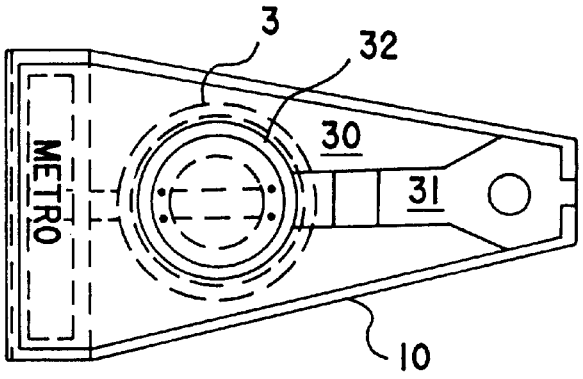
Fig.2
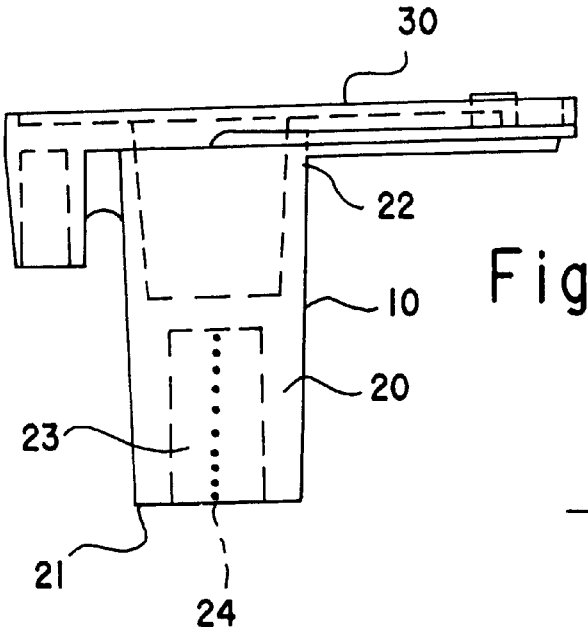
Fig.1
Fig.3
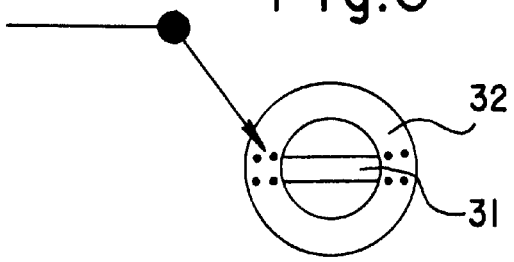

DISTRIBUTOR ROTOR

BACKGROUND OF THE INVENTION

1. Field of the Invention

This invention relates to a distributor rotor for use with an after market distributor cap that is secured to a computer controlled electronic distributor that distributes voltages to spark plugs in internal combustion engines by a distributor cap adapter. More particularly, the invention relates to an injection molded distributor rotor having a stainless steel spring contact and a metallic contact overlaid the stainless steel spring contact for relocating the critical electrical contacts to a desired location when used with the after market distributor cap.

2. Discussion of Related Art

Conventional computer controlled electronic distributors distribute high voltage to spark plugs in various conventional internal combustion engines. After market distributor caps are commercially available and used throughout the automotive after market industry. However, when the conventional computer controlled electronic distributors attempt to distribute a secondary high voltage to an appropriate cylinder at the correct time, a high ignition load circumstance develops for either a secondary wire or sparkplug.

At this point, the secondary high voltage spark can be directed to an incorrect distributor cap terminal, i.e., a wrong cylinder. Furthermore, even though a correct cylinder terminal is closer in distance, the correct cylinder terminal may have a higher load that requires more energy to fire the sparkplug than an adjacent terminal which is longer in distance but lower in load requirements. The wrong cylinder is known in the art as a low demand cylinder that is commonly positioned near fresh fuel and air in the beginning of a compression stroke.

When the high voltage spark goes to the low demand cylinder, a pre-ignition event commonly called cross fire results. Cross fire is defined as firing the wrong cylinder at the wrong time during which an attempt is made to stop a corresponding piston from compressing any further, but cannot occur successfully because of the momentum of the engine assembly. Also, a sudden rise in the pressure and temperature of the conventional internal combustion engine can be approximately 4 to 20 times higher than the engine is designed for regular combustion.

Furthermore, the weakest components of the combustion cycle will be sought out during cross fire. As the piston is usually the weakest component, typical results are a broken center portion of the piston, which results in the complete loss of any combustion processes from taking place, that is, no power is generated. Additionally, crankcase oil will be exposed to intake and exhaust systems through valves, wherein pieces of the piston can contaminate the intake and exhaust systems as well as the crankcase oil.

As a result, damage will extend throughout the conventional internal combustion engine by foreign particles being transported to other areas of the engine. For example, the piston will typically scuff the cylinder wall because of the high heat, thereby ruining the cylinder itself. Also, any one of the connecting rod, connecting rod bearing, and the crankshaft of the engine can suffer damage due to the high pressures they have to endure. Accordingly, the conventional internal combustion engine can be severely damaged.

Injection molded rotors are known in the art. For example, U.S. Pat. No. 1,385,625 to Kent discloses a distributor having a member 10 with a recess 9 that is engaged by an upper end 8 of a cam shaft 7. The member 10 has a transversely extending rib at the bottom of the recess 9 that is integral with the member 10 and engages an offset slot in the upper end 8 of the cam shaft 7, whereby the shaft 7 rotates the member 10. A resilient contact 12 made of spring steel or the like is carried by the member 10 and secured at an end adjacent the outer end of the member 10 and extends substantially radial toward the center and upwardly away therefrom, whereby the free end of the contact 12 is spaced from the member 10 and resists movement toward the member.

The contact 12 may be secured to the member 10 in any suitable way. In the example illustrated in FIG. 2, the contact 12 is held by a screw 13 threaded into the metallic bushing or insert 14 molded into the member 10. The same screw may secure a metallic brush 15 to the member 10, whereby the contact 12 and member 15 are in electrical connection with each other. An upstanding lug 20 is integrally molded with the member 10 and has an undercut 21.

The lug 20 and undercut 21 are so positioned that the free end of the spring contact 12 extends into the undercut 21 and a lip 22 limiting the distance away from the member 10 to which the contact 12 may spring. By the above-described structure, the distance to which the free end of the contact 12 may spring away from the member 10 is limited, yet that contact may yield toward the distributor member 10 while coacting with the terminal 17 carried by the cap 3. The contact 12 cannot spring away from the member 10 to such a distance as might or would interfere with the attachment of the cap 3 to the base 1.

In another example, U.S. Pat. No. 4,030,466 to Lace discloses a synchronous rotor indexing mechanism having an insulating rotor 10. The rotor 10 has a movable contact 11 mounted thereon which can be advanced or retarded, relative a terminal 12. The terminal 12 is a contact inside the housing (not shown) of the distributor (also not shown) which connects to a particular spark plug.

A centrifugal force acting on a weight 13, movably mounted on a shaft 19, causes the weight to moved towards the perimeter of the rotor 10. Two corners 14 of the weight 13 press against the side surface 15 of the contact 11. The contact 11 is pivoted at a pivot point 16, thus, as the weight 13 moves outwardly along the shaft 19, the outward end of the contact 11 is caused to advance relative to the rotor 10 and rotor shaft.

A spring 17 imposes the outward motion of the weight 13 and provides a restoring force for the weight 13 and the contact 11. The shoulders 18 of the rotor are designed to limit the travel of the contact 11, while portions 20 of the rotor serve as stops for the weight 13 and as a base for the shaft 19 and spring 17. The high voltage connection is made by means of a sliding contact engaged with inner most end 21 of the contact 11.

FIG. 5 illustrates an alternative embodiment of the rotor 10 in which the contact member 32 combines the functions of electrical contact, weight, and restoring spring. The contact arm is fixedly mounted at its inner most end 21 to the rotor and has a rod portion connecting the more massive portion at the outmost end. The center of gravity is angularly displaced from the rod portion. As the engine velocity increases, centrifugal force will tend to advance the outmost end of the contact 32 at the bending movement.

FIG. 9 shows another embodiment of the rotor 10 wherein the contact member 44 is eccentrically mounted at and pivoted about a point 45. A vertical portion 46 of the resilient high voltage 12 also provides a restoring force.

In U.S. Pat. No. 4,036,197 to Beshore, an automotive ignition distributor conversion means having an ignition timing motor 22 with an upper transverse arm 24 that terminates at a high tension wiper contact 26 is disclosed. The inner end of the contact 26 at the high tension rotor arm 24 engages a contact button (not shown) on the inner side of the distributor cap 28 which is electrically connected to a high tension socket 34. As the rotor 22 turns, the outer end of the rotor contact 26 wipes across contact buttons (not shown) on the inside of the distributor cap 28 electrically connected to the spark plug cable sockets 32 to apply the high tension voltage to the spark plug in the proper firing order. The high tension motor 22 is mounted on the upper end of the motor shaft 18 of the distributor body 16.

U.S. Pat. No. 4,077,378 Okumura discloses a distributor with a rotor 1 fixed to an upper portion of a shaft of the distributor to rotate in response to the rotation of crank shaft. The rotor 1 and cap 2 have a rotor electrode 3 made of brass in the plurality of electrodes 4 made of aluminum. The rotor electrode 3 faces to the side of electrodes 4 and has a thin metal member 5 made of stainless steel, which is secured thereto by spot welding 6. The metal member 5 has a width extending in the rotational direction of the rotor electrode 3 to cover all the spark timings. The stainless steel member 5 can be steel, aluminum, brass or copper, and fixed by soldering or rivets.

U.S. Pat. No. 4,096,840 to Jordan discloses an ignition distributor having a rotor member 38 made of a dielectric material, such as a plastic or the like, frictionally held in position and keyed in an appropriate angular position relative to the shaft 16. A flat spring 42 is supported by the rotor 38 wherein the end of the flat spring is consistently in engagement with the projecting end of the terminal 24 of the cap 18. The other end of the spring is attached to a projecting end of the rotor 38.

As such, although injection molded rotors appear to be known, none of the above-listed and/or described references disclose an injection molded rotor designed to eliminate the possibility of a high demand situation from occurring. Furthermore, because eliminating the high demand situation from occurring is difficult to accomplish given that maintenance intervals, defective parts, equipment abuse, and operating conditions are all but impossible to monitor as a primary supplier of conventional internal combustion engines having distributors, recent manufacturers have eliminated the distributor from the conventional engines altogether. Accordingly, there is a need for a solution for conventional engines still using the conventional controlled electronic distributor.

SUMMARY OF THE INVENTION

An object of this invention is to overcome the above-discussed drawbacks of the conventional distributor rotor.

Another object of this invention is to provide a distributor rotor that relocates the critical contacts when used with an after market distributor cap secured to a conventional computer controlled electronic distributor by an after market distributor cap adaptor. The distributor rotor permits the after market distributor cap, which has a larger diameter than conventional distributor caps, to be installed on the conventional computer controlled electronic distributor to eliminate ignition cross fire. In particular, the after market distributor cap adaptor provides a larger terminal diameter distance than conventional distributor caps, which results in an increase in an insulating distance.

The distributor rotor of this invention has an injection molded rotor body with a stainless steel spring voltage in contact and a metallic, preferably brass, distributor contact overlaid for electrical contact. The voltage in contact and distributor contact are both hot riveted to the rotor body. Additionally, a shank of the distributor rotor that fits over a shaft of the distributor is press fit and keyed for proper alignment.

BRIEF DESCRIPTION OF THE DRAWINGS

Other objects and features of this invention will be better understood from the following description, with reference to the accompanying drawings, wherein:

FIG. 1 is a partial cross-sectional side view of the distributor rotor according to this invention;

FIG. 2 is a top view of the distributor rotor illustrated in FIG. 1; and FIG. 3 is an isolated view of a distribution contact overlaid a portion of a voltage in contact.

DETAILED DESCRIPTION OF PREFERRED EMBODIMENT

Referring to FIG. 1, a distributor rotor 10 according to the invention is illustrated.

The distributor rotor 10 is formed by injection molding and includes a shank portion 20 and a body member 30. The shank portion 20 has a first end 21 and a second end 22 axially opposite the first end 21. The first end 21 of the shank portion 20 has a shank recess 23 configured to be press fit to and rotated by an upper portion of the distributor or driving shaft (not shown) in response to rotation of a crank shaft (not shown) of an internal combustion engine. An after market distributor cap (not shown) is fixed to a housing (not shown) of the distributor to cover the rotor 10.

The body member 30 is attached, either integrally or by other well known methods, to the second end 22 of the shank portion 20. Referring to FIG. 2, the body member 30 includes a spring type voltage in contact 31 and a distribution contact 32 overlaid the voltage in contact 31 (FIG. 3). The voltage in and distributor contacts 31 and 32, respectively, are each connected to the body member 30 of the rotor 10. Preferably, the contacts 31 and 32 are hot riveted to the body member 30, but any other suitable method of connecting the contacts 31 and 32 to the body member 30 is within the scope of this invention.

The voltage in contact 31 is preferably made of stainless steel, but any other suitable material may be used so long as the suitable material can at least be attached to the body member 30 by hot riveting. For example, the stainless steel spring type voltage in contact could be made of, but is not limited to any one of steel, aluminum, brass, or copper, and be attached by soldering or spot welding, instead of hot riveting.

The distribution contact 32 is preferably made of brass, but as in the voltage in contact 31 discussed above, any suitable material may be used so long as the suitable material can at least be attached to the body member 30 by hot riveting. The distribution contact 32 is illustrated as being circular, but it is within the scope of this invention to use any suitable geometric shape, such as, for example, rectangular, triangular, and the like, as long as the contact 32 can be overlaid the voltage in contact 31. Furthermore, the distribution contact 32 is overlaid the voltage in contact 31 at a position that is substantially coaxial with a shank axis 24 of the shank portion 20.

The after market distributor cap has a center input terminal (not shown), to which one end of an associated ignition coil secondary winding and a plurality of output terminals are connected. The output terminals are connected to corresponding spark plugs in a manner well known in the art. The center input terminal of the after market distributor cap is arranged to be in electrical contact with the distribution contact 32.

As such, the center input terminal, distribution contact 32, and voltage in contact 31 are electrically connected to each other. With this arrangement, by relocating the location of the critical distribution and voltage in contacts, an ignition spark potential produced by the secondary winding of the associate ignition coil may be delivered to successive ones of the distributor cap output terminals as the distributor rotor 10 is rotated by the distribution shaft in timed relationship with the internal combustion engine.

Furthermore, the dimensions of the distributor rotor 10 of this invention, are ideally within the range of 2.50 inches to 3.50 inches in length, 1.25 inches to 1.75 inches in width, and a height of 1.50 inches to 2.10 inches. Preferably, the rotor is 2.89 inches long, 1.43 inches wide and stands 1.79 inches high. However, it should be noted that it is within the scope of this invention to vary any one of or all of the above dimensions according to the dimensions and size configurations of the other components of the internal combustion engine in which the distributor rotor 10 is implemented.

Many modifications may be made to adapt the teachings of the distributor rotor of this invention to particular situations or materials without departing from the scope thereof. Therefore, it is contended that this invention not be limited to the particular embodiment disclosed herein, but includes all embodiments within the spirit and scope of the disclosure.

I claim:

1. A distributor rotor having shank portion with an axis and a body member attached to the shank portion, comprising:

a voltage in contact attached to the body member; and a distribution contact attached to the body member and overlaid the voltage in contact, wherein the distribution contact is substantially coaxial to the axis of the shank portion.

2. The distributor rotor according to claim 1, wherein the voltage in contact is made from a material chosen from a group comprising stainless steel, steel, aluminum, brass, and copper.

3. The distributor rotor according to claim 1, wherein the distribution contact is made from brass.

4. The distributor rotor according to claim 1, wherein the distribution rotor has a length in a range between 2.50 and 3.50 inches, a width in a range between 1.25 and 1.75 inches, and a height in a range between 1.50 and 2.10 inches.

5. The distributor rotor according to claim 4, wherein the length is 2.89 inches, width is 1.43 inches and height is 1.79 inches.

6. The distributor rotor according to claim 1, wherein the voltage in and distribution contacts are attached to the body member by any one of hot riveting, soldering, and welding.

7. The distributor rotor according to claim 1, wherein the distribution contact is either one of circular, rectangular, and triangular.

8. An injected molded distributor rotor attachable to an upper portion of a distributor shaft, comprising:

a shank portion having a first end and a second end axially opposite the first end, the second end having a shank recess formed therein such that the shank portion can be press fit onto the upper portion of the distributor shaft;

a body member attached to the second end of the shank member;

a voltage in contact attached to the body member; and a distribution contact attached to the body member and overlaid the voltage in contact, wherein the distribution contact is substantially coaxial to the axis of the shank portion.

9. The distributor rotor according to claim 8, wherein the voltage in contact is made from a material chosen from a group comprising stainless steel, steel, aluminum, brass, and copper.

10. The distributor rotor according to claim 8, wherein the distribution contact is made from brass.

11. The distributor rotor according to claim 8, wherein the distribution rotor has a length in a range between 2.50 and 3.50 inches, a width in a range between 1.25 and 1.75 inches, and a height in a range between 1.50 and 2.10 inches.

12. The distributor rotor according to claim 11, wherein the length is 2.89 inches, width is 1.43 inches and height is 1.79 inches.

13. The distributor rotor according to claim 8, wherein the voltage in and distribution contacts are attached to the body member by any one of hot riveting, soldering, and welding.

14. The distributor rotor according to claim 8, wherein the distribution contact is either one of circular, rectangular, and triangular.

* * * * *